US005971639A

United States Patent [19]

Park

[11] Patent Number: 5,971,639

[45] Date of Patent: Oct. 26, 1999

[54] PAPER CUTTING APPARATUS IN A SMALL-SIZED PRINTER

[75] Inventor: Won Chul Park, Kyunggi-do, Rep. of Korea

[73] Assignee: Samsung Electro-Mechanics Co., Ltd., Kyunggi-Do, Rep. of Korea

[21] Appl. No.: 08/939,032

[22] Filed: Sep. 26, 1997

[30] Foreign Application Priority Data

Nov. 11, 1996 [KR] Rep. of Korea ..... 96-53191
Nov. 11, 1996 [KR] Rep. of Korea ..... 96-53192

[51] Int. Cl.[6] ..... B41J 11/68

[52] U.S. Cl. ..... 400/621; 101/93.07; 83/697

[58] Field of Search ..... 400/621; 101/93.07, 101/226; 83/49, 582, 862, 879, 880, 881, 882, 697

[56] References Cited

U.S. PATENT DOCUMENTS

| | | | |
|---|---|---|---|
| 4,211,498 | 7/1980 | Shimizu et al. | 400/621 |
| 4,302,119 | 11/1981 | Siegenthaler | 400/621 |
| 5,505,552 | 4/1996 | Hasegawa et al. | 400/621 |
| 5,613,788 | 3/1997 | Dobring | 400/621 |
| 5,727,889 | 3/1998 | Koyabu | 400/621 |

FOREIGN PATENT DOCUMENTS

| | | | |
|---|---|---|---|
| 3-82575 | 4/1991 | Japan | 400/621 |

OTHER PUBLICATIONS

IBM Tech. Disc. Bulletin vol. 26, No. 8 "Compact Cutter Guillotine", Jan. 1984.
IBM Tech. Disc. Bulletin vol. 32 No. 3B "Customer Replaceable Cash Receipt Cutter", Aug. 1989.
IBM Tech. Disc. Bulletin vol. 31 No. 5 "Receipt Paper Cutoff Mechanism", Oct. 1988.

*Primary Examiner*—Ren Yan
*Attorney, Agent, or Firm*—Ladas & Parry

[57] ABSTRACT

A paper cutting apparatus in a small-sized printer for issuing vouchers or receipts having a cutter base with a paper inlet in one side, a fixed cutter installed on an upper surface of the cutter base, and a cutter cover installed on the upper portion of the cutter base to define a space with the cutter base. A movable cutter is installed on an upper side of the cutter base and has an upright shaft pin connected to a driving mechanism. A guide unit is provided at the lower portion of the movable cutter to produce rectilinear movement of the movable cutter. The driving mechanism includes a driven cam installed on the cutter cover and receiving the shaft pin for moving the movable cutter. A compressive unit contacts the upper surface of the movable cutter to apply a resilient pressing force on the movable cutter to keep it in contact with the fixed cutter during the paper cutting operation. A frictional force decreasing device acts between the cutter base and the movable cutter to decrease friction therebetween. An auxiliary cam operates an on/off switch for timely stopping the driving mechanism.

22 Claims, 9 Drawing Sheets

FIG. 9
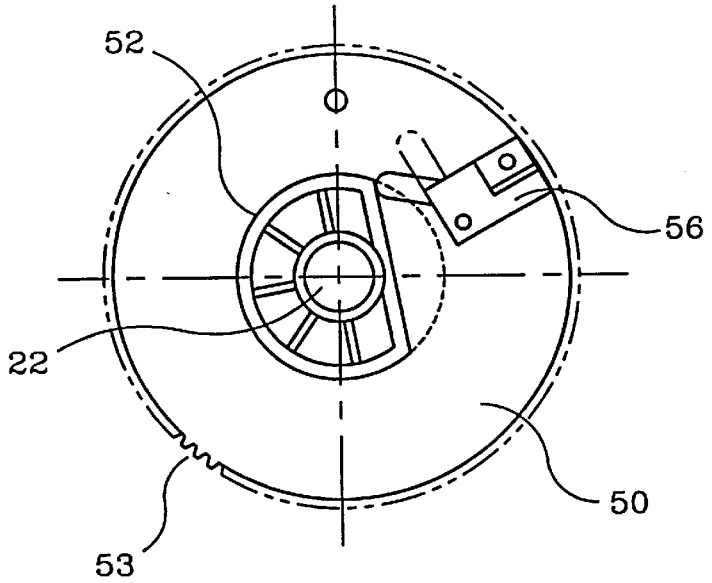
FIG. 10
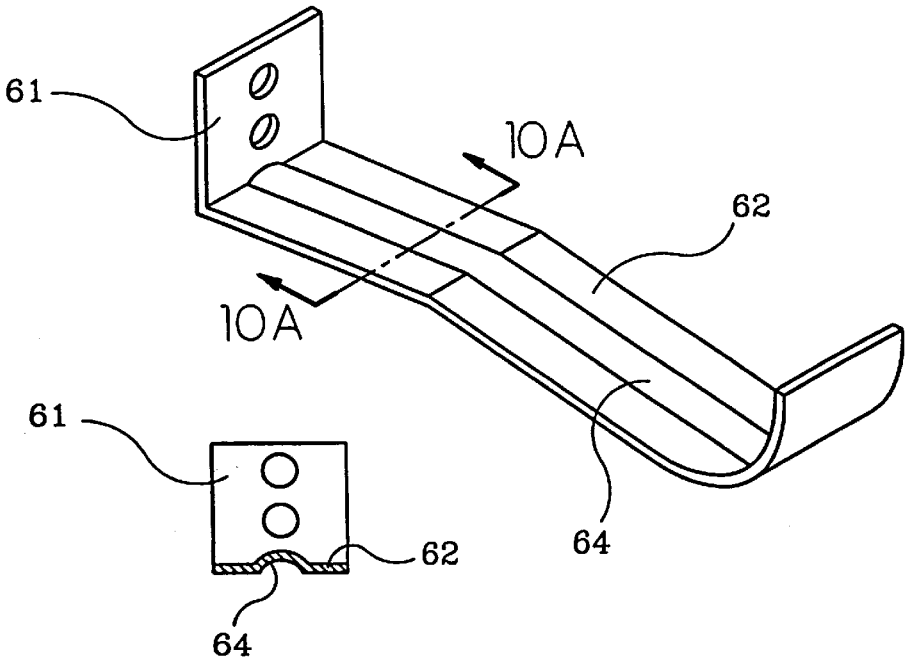
FIG. 10A

PAPER CUTTING APPARATUS IN A SMALL-SIZED PRINTER

BACKGROUND OF THE INVENTION

1. Field of the Invention

The present invention relates to an apparatus for cutting a sheet of paper in a small-sized printer for issuing vouchers or receipts, and more particularly to a paper cutting apparatus in a small-sized printer for consistently applying a compression force when a movable cutter is moved toward a fixed cutter to perform a cutting operation and accurately shifting from a rotative motion to a linear motion by a simple structure without dissipating motive power.

2. Description of the Prior Art

A small-sized printer of a variety of cash registers for issuing vouchers and receipts requires a paper cutting apparatus, and such a conventional paper cutting apparatus mounted to be used in various cash registers is illustrated in FIGS. 1, 2 and 3.

The conventional paper cutting apparatus, as shown in FIG. 1, includes a cutter base 1 placed at the lower side and a cutter cover 2 adapted to be coupled to cutter base 1 to cover the base. Referring to FIG. 2, cutter base 1 is formed with a narrow and horizontally-elongated paper inlet 12, and cutter cover 2 is formed with a paper outlet 21. Paper inlet 12 is provided with a fixed cutter 3.

A movable cutter 4 is disposed above cutter base 1 to reciprocate in a manner such that an edge of cutter crosses over cutter 3 to cut a sheet of paper passing through paper inlet 12.

Also, movable cutter 4 performs a linear reciprocating motion by means of a guide unit 8, and a motive power needed for the linear reciprocating motion is transmitted from a driving unit 90.

Guide unit 8 has a slide hole 13 in cutter base 1 elongated toward fixed cutter 3, and a slide plate 81 fitted into slide hole 13 while being fixed to the bottom plane of movable cutter 4. In addition, a plate 82 is fixed to the bottom plane of slide plate 81 to be wider than slide plate 81, and a pressing plate 19 pushes movable cutter 4 from the upper side thereof. Pressing plate 19, movable cutter 4, slide plate 81 and plate 82 are coupled as a unitary body by means of a pin member 91, and a shaft pin 92 is installed upright at the rear side for receiving the motive power.

Driving unit 90 includes a worm gear 95 fixedly installed to the bottom plane of cutter cover 2, a worm 96 for rotating worm gear 95 and a driving motor 54 fixedly installed with worm 96 connected to a motor shaft thereof. A swing lever 9 is furnished in such a manner to swing about one hinge point 98 of cutter base 1, lever 9 receiving a shaft pin 92 of movable cutter 4 in a slit 93 in the lever. The lever also receives a pin 97 on the worm gear 95 in a draw hole 94 in the lever.

In view of the above-described construction, worm 96 fixedly installed on the motor shaft of driving motor 54 rotates worm gear 95, and pin 97 on worm gear 95 is rotated one revolution to cause swing lever 9 to swing up and down once.

When swing lever 9 swings, shaft pin 92 inserted into slit 93 in the lever advances and retreats moving cutter 4. For this motion, cutter 4 performs a linear reciprocating motion under the guidance of guide unit 8 to cut the sheet of paper placed between movable cutter 4 and fixed cutter 3.

However, the foregoing conventional paper cutting apparatus has the problems listed below.

First, swing lever 9 is employed for converting the rotating motive power of the motor into the linear motion of movable cutter 4.

This involves the drawbacks of requiring lever 9, hinge point 98 for installing lever 9 and the necessary space to accommodate swinging lever 9 which requires a lot of parts and restricts the design.

Second, the motive power is greatly dissipated.

As mentioned above, movable cutter 4 receives the corresponding pressure where it is closely attached to cutter base 1 by means of pressing plate 19, and, as shown in FIGS. 1 to 3, both end portions of movable cutter 4 freely overlap the fixed cutter 3. Accordingly, movable cutter 4 can slant when it is moved in the advancing direction by an angle θ.

If movable cutter 4 is moved forwardly in this state, angle θ is further increased this produces undesirable increase in the compression force and the load resistance.

That is, the state as shown in FIG. 2 is obtained in the initial state when movable cutter 4 starts to move in the advancing direction. Here, when movable cutter 4 is moved in the advancing direction, it is moved as shown in FIG. 3. At this time, if pressing plate 19 and movable cutter 4 are moved in the advancing direction, two points are fixed by shaft pin 92 and pin member 91 as shown in FIGS. 1 and 3. Due to this fact, the slant angle is further increased as movable cutter 4 is moved in the advancing direction.

The cutting load is gradually increased which incurs the problem of requiring a great force to perform the cutting operation.

SUMMARY OF THE INVENTION

Therefore, it is an object of the present invention to provide a paper cutting apparatus in a small-sized printer, wherein, in order to solve the above-enumerated conventional problems heretofore, a cam mechanism serves for converting a rotative motion to a linear motion in performing the cutting operation and reciprocate the movable cutter directly for reducing the need for many parts and attaining an accurate operation while an abnormal increase of a compression force when the cutter performing the cutting operation is moved in the advancing direction is inhibited to decrease load and afford a consistent driving force required for the cutting operation.

To achieve the above object of the present invention, a paper cutting apparatus in a small-sized printer includes a cutter base provided with a paper inlet in one side thereof, a fixed cutter installed at one side of an upper portion of the cutter base, and a cutter cover installed on an upper portion of the cutter base for defining a space with the cutter base. Also, a movable cutter installed to the upper side of the cutter base is provided with an upright shaft pin extending toward the upper portion from the center of the cutter while closely adjoining the upper portion of the fixed cutter, the movable cutter has a guide unit at the lower portion thereof for providing straight advancing movement of the movable cutter. A cam is installed at the bottom plane of the cutter cover and receives the shaft pin of the movable cutter for producing the movement of the movable cutter, and a driving unit applies a rotative force to the cam. A compressive unit contacts the upper plane of the movable cutter and applies an elastic compression force during the paper cutting operation while being fixed to the cutter base, a frictional force decreasing unit placed between the cutter base and the movable cutter contacts the cutter base and the movable cutter for maintaining a balance between the cutter base and the movable cutter during the movement of the movable cutter to decrease friction between the cutter base and the movable cutter. An auxiliary cam is provided on a shaft of the cam for turning a switch on and off to timely stop the driving unit.

BRIEF DESCRIPTION OF THE DRAWINGS

The above objects and other advantages of the present invention will become more apparent by describing in detail preferred embodiments thereof with reference to the attached drawings in which:

FIG. 9 is a plan view showing the cam according to the present invention;

FIG. 10 is a perspective view showing the elastic plate according to the present invention;

FIG. 10A is a section taken on line 10A—10A in FIG. 10;

DETAILED DESCRIPTION OF THE PREFERRED EMBODIMENT

Figure 4:
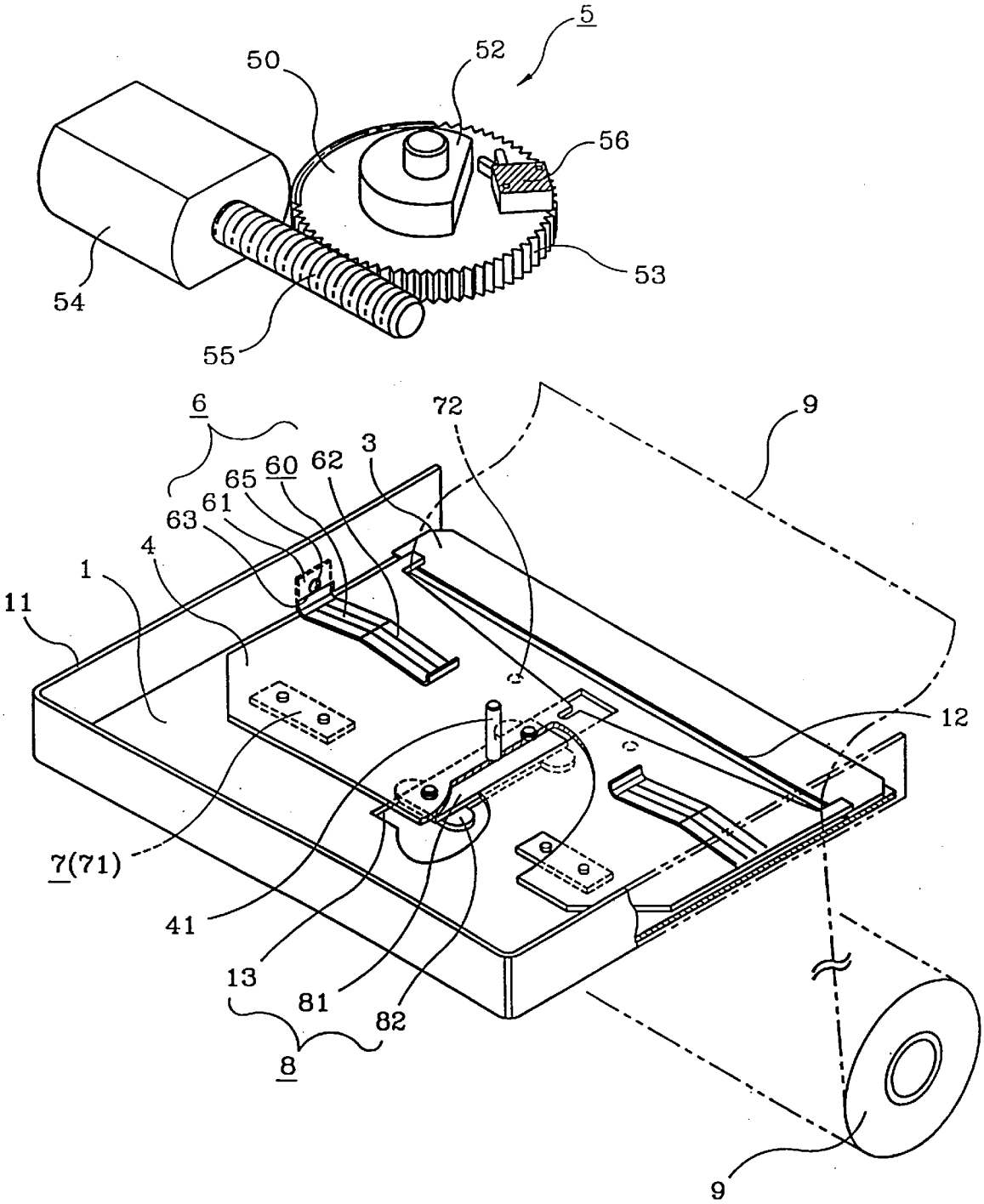
FIG. 4 is an exploded perspective view showing the overall construction of a paper cutting apparatus according to the present invention.
Figure 5:
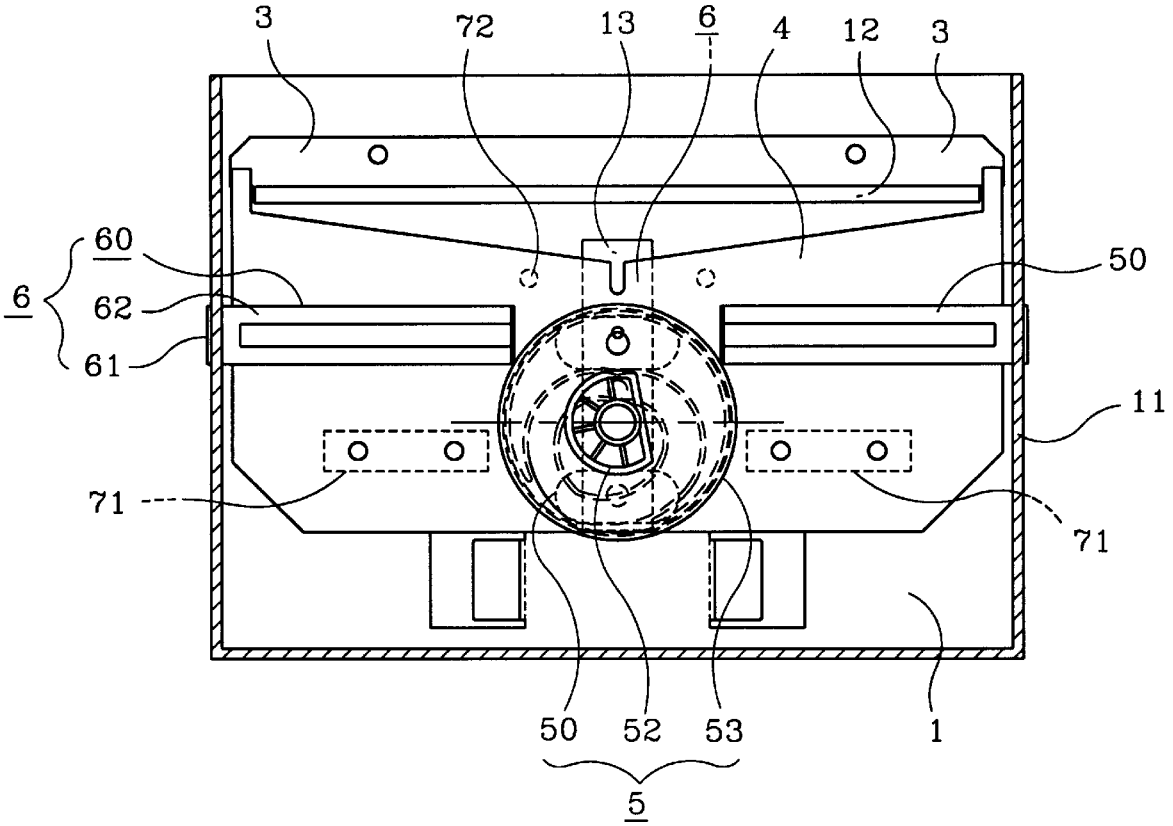
FIG. 5 is a plan view showing the overall construction of the paper cutting apparatus according to the present invention.
Figure 6:
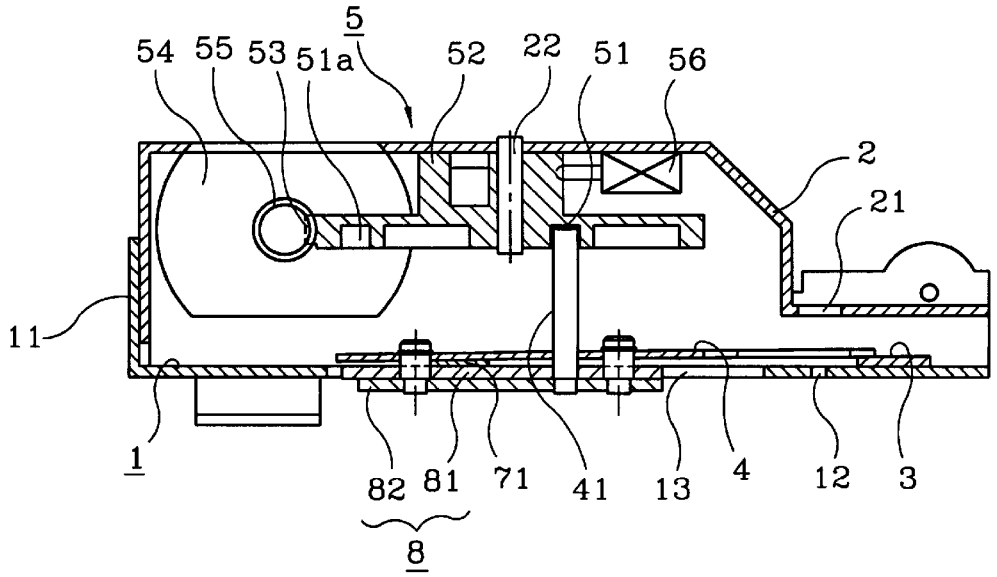
FIG. 6 is a side section view showing a state prior to operating the paper cutting apparatus according to the present invention.
Figure 7:
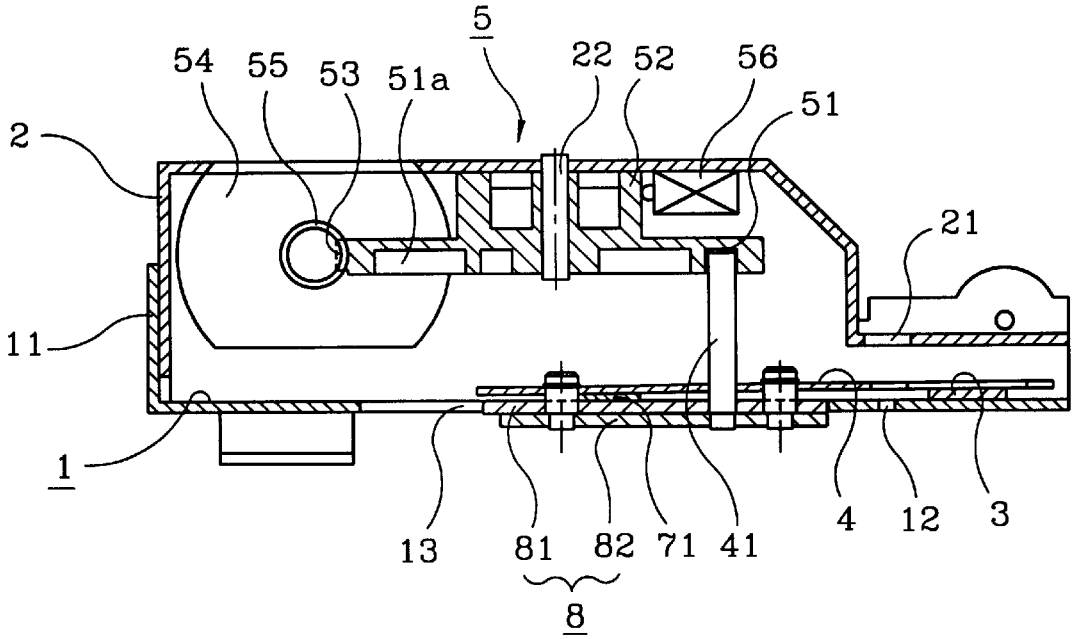
FIG. 7 is a side section view showing a state after operating the paper cutting apparatus according to the present invention.

FIG. 4 is an exploded perspective view showing an overall construction of a paper cutting apparatus according to the present invention, and FIG. 5 is a plan view which also shows the overall construction of the present invention. FIGS. 6 and 7 respectively show before and after operating states.

Figure 8:
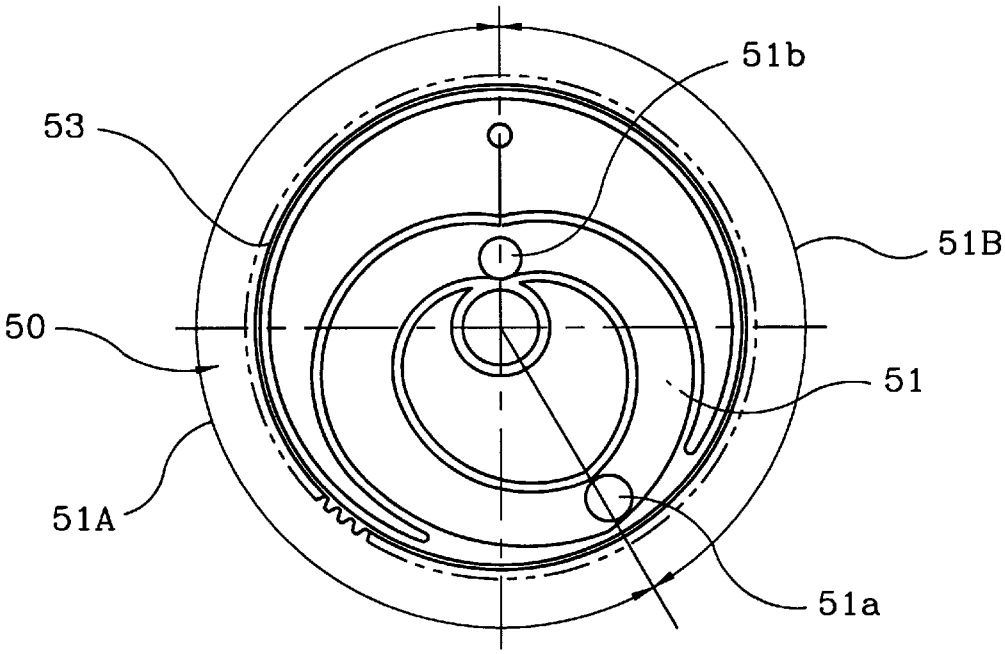
FIG. 8 is a bottom side view showing the cam according to the present invention.
Figure 11:
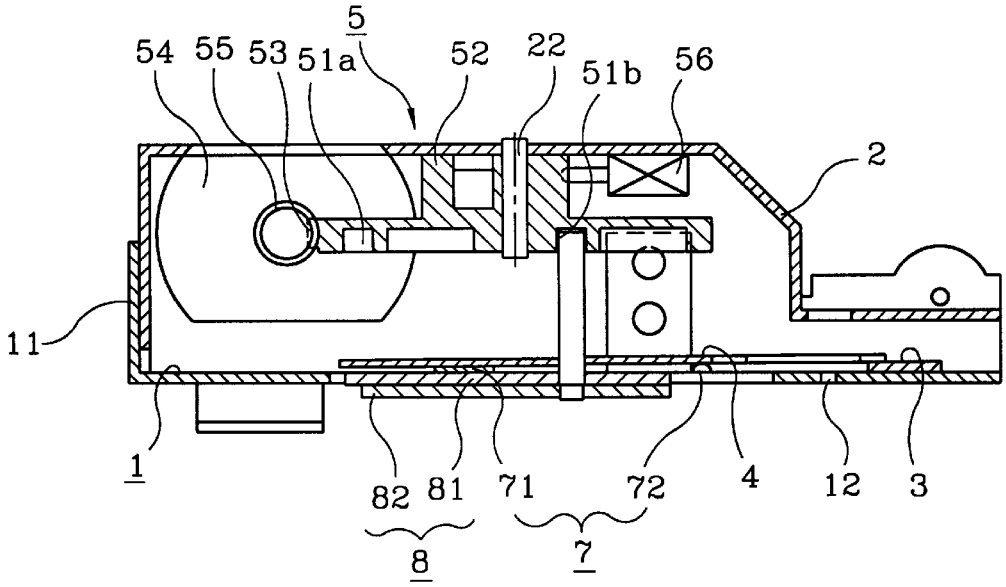
FIG. 11 is a side section view showing the movable cutter sustaining unit.
Figure 12:
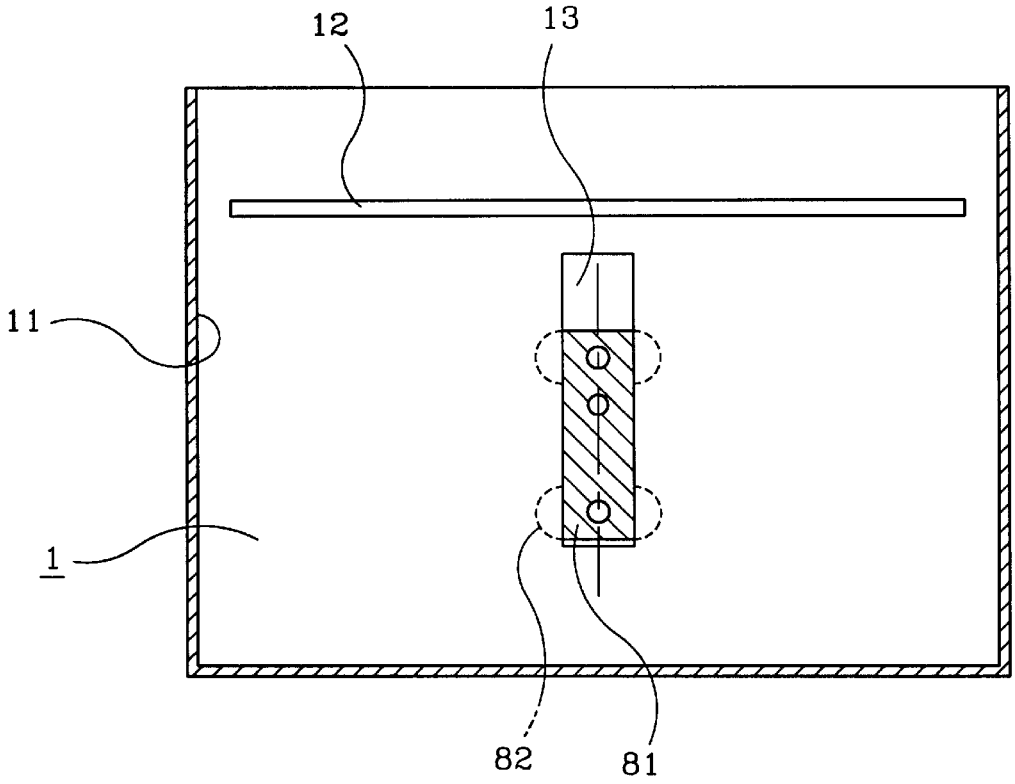
FIG. 12 is a plan section view of the major portion showing the guide unit according to the present invention.

FIGS. 8 and 9 illustrate a cam mechanism 5 according to the present invention, and FIG. 10 shows an elastic plate 60 of a compressive unit 6. FIG. 11 is a side view showing a frictional force decreasing unit 7, and FIG. 12 shows a guide unit 8.

A cam 50 of cam mechanism 5 serves for causing the movable cutter 4 to execute the advancing/retreating motion, as shown in FIG. 8, a circular cam groove 51 being formed in the bottom planes cam 50 being secured on a fixing shaft 22. An auxiliary cam 52 is formed on the upper plane of cam 50 and a worm gear 53 is formed along the outer periphery of cam 50. Additionally, a worm 55 of a motor 54 is in meshing engagement with worm gear 53 of cam 50 to transmit motive power thereto. Cam groove 51 of cam 50 receives a shaft pin 41 extending from the upper plane of movable cutter 4 to be guided in the groove.

In this construction, as shown in FIG. 8, cam groove 51 is of heart shape and defines a bottom dead center 51*b* for movable cutter 4 in a retreated state and a top dead center 51*a* for an advanced state. Particularly, a retreating section 51B for retreating movable cutter 4 is shorter than an advancing section 51A for advancing it to thereby cause very quick return of movable cutter 4.

The aforementioned auxiliary cam 52, as shown in FIG. 9, is obtained by cutting a portion of its circumference to enable it to turn a switch 56 on/off during rotating of cam 50. This operation is related to the position of movable cutter 4 and the operation of motor 54 as is to be described later.

Now, guide unit 8 for guiding the advancing/retreating operation of movable cutter 4 in the straight travelling state will be described.

As shown in FIG. 4 or 12, an elongated slide hole 13 is formed in the bottom of cutter base 1, a slide plate 81 is perfectly fitted into slide hole 13 and is fixed to the bottom plane of movable cutter 4, and a fixed plate 82 is fixed to slide plate 81 at the opposite side of slide hole 13 for preventing deviation.

A compressive unit 6 for applying pressure against movable cutter 4, as shown in FIG. 10, is formed by an elastic plate 60, of which the following characteristic features are important.

More specifically, it is formed in the shape of an L consisting of a vertical end 61 and a horizontal end 62. When fixing compressive unit 6, a fixing hole 63 is formed in both side walls 11 right and left or rear side walls 11 of cutter base 1. Then, vertical end 61 is fixed by means of a screw. Once vertical end 61 is fixed in this way, horizontal end 62 has an inherent elasticity for applying pressing force downward on the movable cutter.

In forming elastic plate 60 as described above, it is preferable that the edge of horizontal end 62 is bent upward to be rounded for the purpose of reducing friction with respect to the upper plane of movable cutter 4, and an indenting or embossing groove part 64 is formed in the lengthwise direction of horizontal end 62 for the purpose of increasing the elasticity.

Meantime, when elastic plate 60 of compressive unit 6 is used in compressing for applying pressing force on movable cutter 4, it may be provided at both right and left sides of cutter base 1. In addition to using it at both sides horizontal end 62 may be fixed in the transversal direction or in the direction of movement of movable cutter 4. If necessary, vertical end 61 can be fixed to cutter cover 2 and not to cutter base 1 to allow horizontal end 62 to press against movable cutter 4. Such orientation should be considered in view of various characteristics of the paper cutting apparatus.

When movable cutter 4 is moved, frictional force decreasing unit 7 to enable it to move with minimum friction is formed by a contact plane member 71 or by a projection 72 as shown in FIG. 11.

Contact plane member 71 and projection 72 are illustrated in FIGS. 4, 5 and 11, in which contact plane member 71 is attached to the upper plane of cutter base 1 and projection 72 integrally protrudes from cutter base 1 toward the upper plane.

Figure 13:
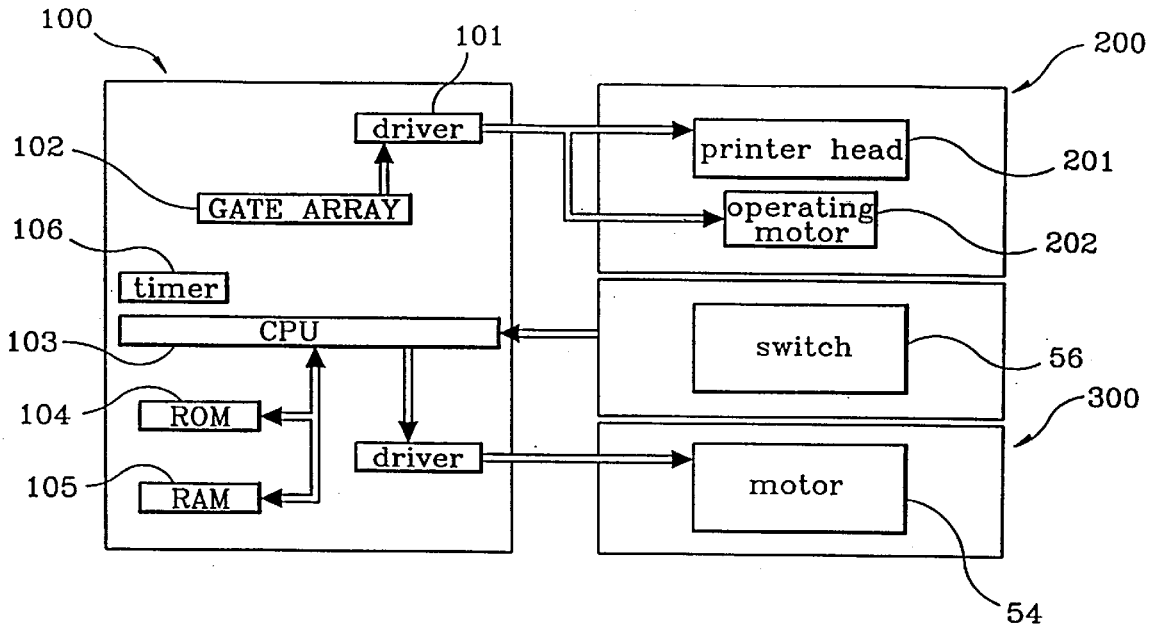
FIG. 13 is a block diagram of a printer using the paper cutting apparatus according to the present invention.

FIG. 13 is a block diagram showing an embodiment of a printer equipped with the paper cutting apparatus according to the present invention, which is largely classified into a left controller unit 100, a right printer part 200 and bottom right paper cutter part 300. Controller unit 100 includes a driver 101, a gate array 102, a CPU 103, a ROM 104, a RAM 105 and a timer 106. Printer part 200 has a head 201 and an operating motor 202 for feeding the sheet of paper. Also, paper cutter part 300 is provided with switch 56 controlled by auxiliary cam 52 and motor 54 for driving cam 50.

In the drawings, reference character P denotes the sheet of paper, and 21 is the paper outlet.

An operating state of the paper cutting apparatus formed as above will be described hereinbelow.

First, as shown in FIG. 4, upon the operation of motor 54, worm gear 53 is rotated by meshing engagement with worm 55 thereby causing cam 50 to be rotated.

Figure 1:
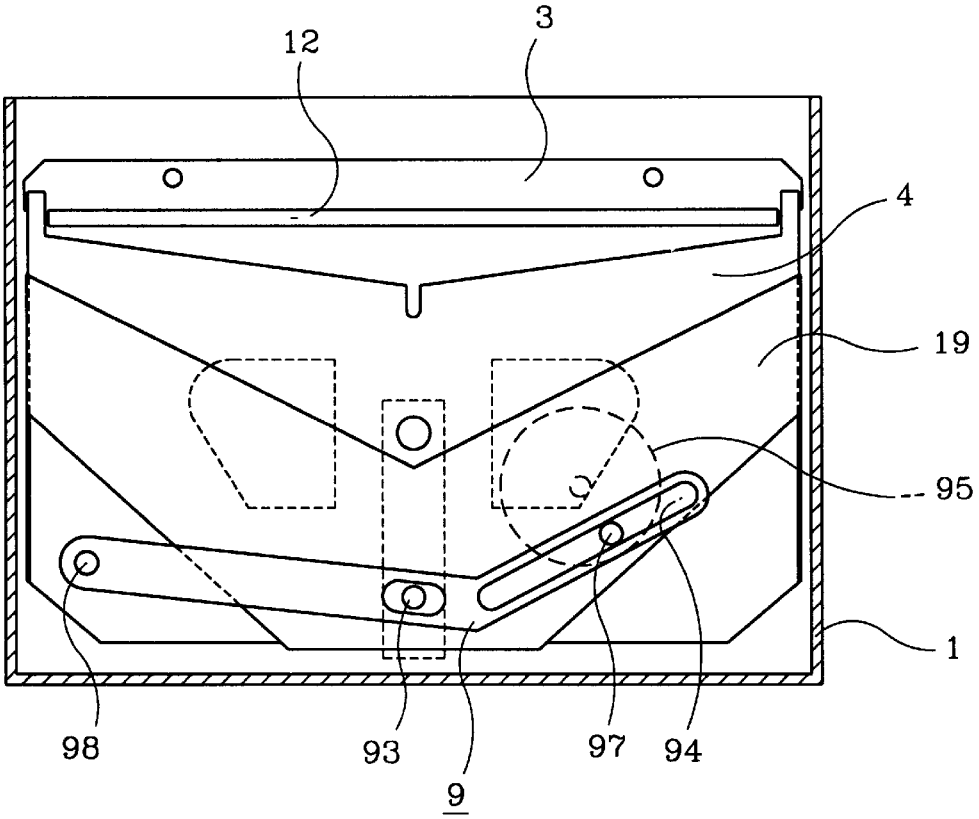
FIG. 1 PRIOR ART
FIG. 1 is a plan view showing a construction of a conventional paper cutting apparatus.
Figure 2:
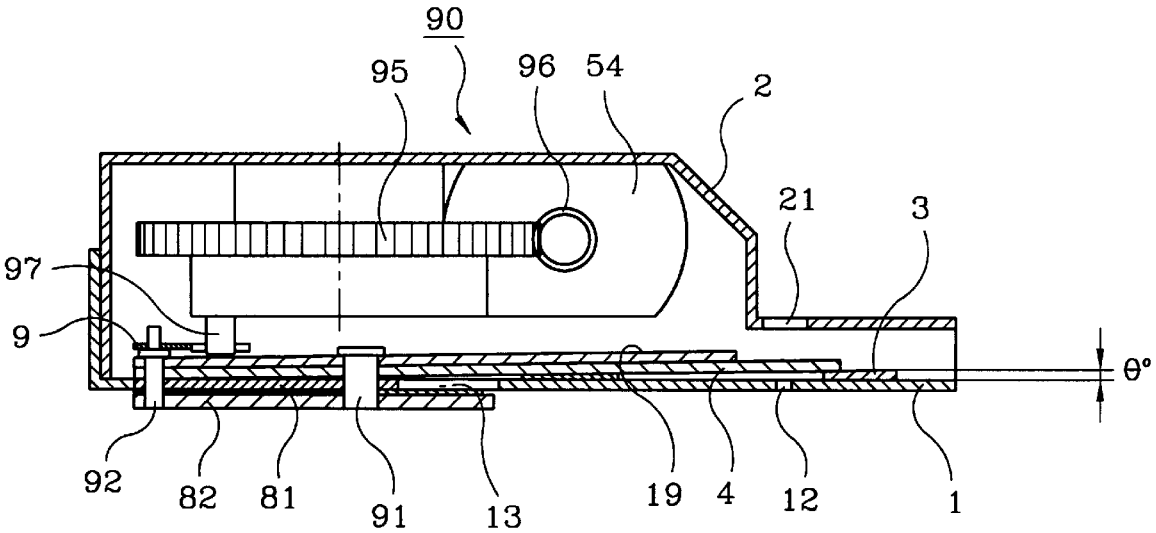
FIG. 2 PRIOR ART
FIG. 2 is a side section view showing the construction of the conventional paper cutting apparatus.
Figure 3:
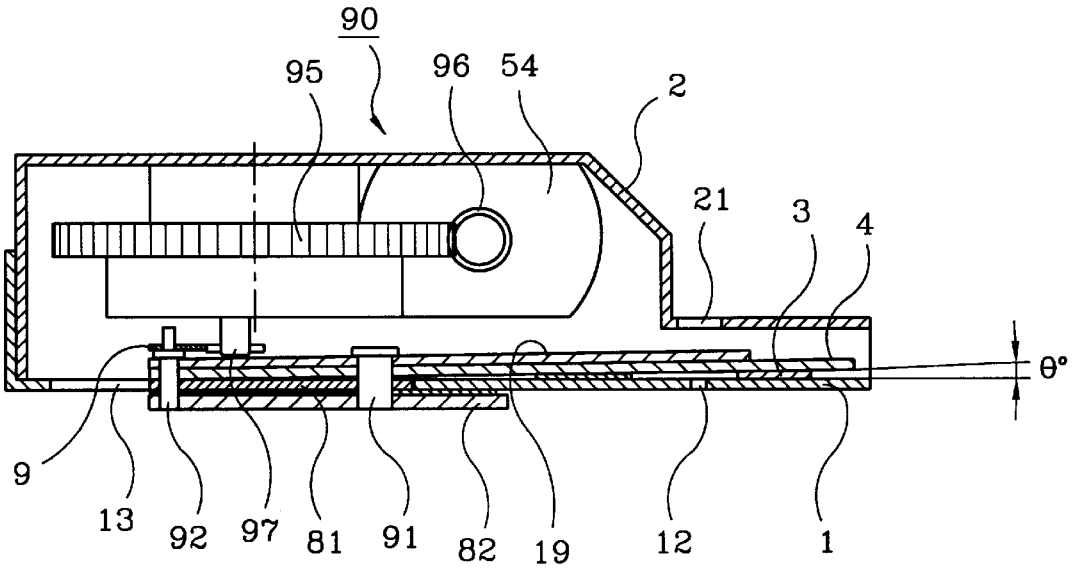
FIG.3 PRIOR ART
FIG. 3 is a side section view showing an operating state of the conventional paper cutting apparatus.

When cam 50 is rotated, shaft pin 41 inserted into cam groove 51 in the bottom plane thereof is moved along cam groove 51. Therefore, the force to move the movable cutter 4 is transferred thereto, and at this time, cutter 4 is operated in the state of FIG. 7 from the state of FIG. 3 or in the state of FIG. 6 from the state of FIG. 7. Here, movable cutter 4 effectively advances or retreats by means of guide unit 8, compressive unit 6 and frictional force decreasing unit 7 to execute the cutting operation upon sheet of paper P which passes through paper inlet 12 by the cutting operation together with fixed cutter 3.

During this operation, the moving state of cam groove 51 of cam 50 and shaft pin 41 will be described in more detail with reference to FIG. 8.

Once cam 50 is rotated, shaft pin 41 fitted into cam groove 51 is moved from bottom dead center 51*b* to top dead center 51*a* via advancing section 51A. By this operation, cutter 4 installed with protruding shaft pin 41 advances.

When shaft pin 41 is moved to top dead center 51*a* of cam groove 51, cutter 4 is moved such that the cutting edge thereof passes over fixed cutter 3 to cut the sheet of paper as shown in FIG. 7. Then, if cam 50 is continuously rotated, shaft pin 41 is moved along retreating section B from top dead center 51*a* to bottom dead center 51*b*. Consequently, cutter 4 retreats to return to its original position as shown in FIG. 6. Since retreating section 51B of cam groove 51 is shorter than advancing section 51A, cutter 4 is slowly moved when advancing to cut the sheet of paper, and quickly retreats when returning after cutting the sheet of paper.

Also, cutter 4 performs the linear reciprocating motion by means of the foregoing guide unit 8.

That is, slide plate 81 fixed to the bottom plane of movable cutter 4 has a width perfectly fitted into elongated slide hole 13. In this state, when slide plate 81 is applied with the force of moving shaft pin 41 of movable cutter 4, it is moved in the lengthwise direction of slide hole 13, thereby accomplishing the correct linear motion.

When movable cutter 4 executes the reciprocating motion to cut sheet of paper P as described above, elastic plate 60 of compressive unit 6 for affording the pressing force is operated as follows.

First, as shown in FIGS. 4 and 5, while vertical end 61 of elastic plate 60 is firmly fixed via fixing hole 63 of cutter base 1, horizontal end 62 presses against the upper plane of plate-shaped movable cutter 4. Therefore, the cutting edge portion is moved in a state of being closely engaged with fixed cutter 3, so that the contact between the cutting edges is maintained in an optimum state.

Above all, since horizontal end 62 of elastic plate 60 is formed with embossing groove part 64 in the lengthwise direction as shown in FIG. 8, the elastic force is increased so as to be effective. Furthermore, the marginal end is bent upward thus minimizing the frictional force.

The reason for arranging elastic plate 60 in the transversal direction with respect to the moving direction of cutter 4 as shown in FIG. 5 is for effectively utilizing the space occupied by cam 50 and other parts. Also, it may be arranged in the moving direction of cutter 4 for further decreasing the frictional force, if necessary. Besides, by fixing it to the rear sidewall as well as the right and left side walls, greater compression force can be provided.

Despite being continuously applied with the compression force as described above, cutter 4 has frictional force decreasing unit 7 which effectively reduces the friction at the bottom to carry out smooth movement.

In other words, as shown in FIG. 11, cutter 4 has contact plate member 71 attached to the upper plane of cutter base 1, so that the portion substantially involving the friction is in an extremely narrow area. Especially, as shown at the right in FIG. 11, projection 72 protruding from the bottom of cutter base 1 enables the sliding with almost no friction so as not to impose a great resistance to motor 54 and cam mechanism 5.

On the other hand, auxiliary cam 52 formed on the upper plane of cam 50 operates switch 56 to control the cutting state of sheet of paper P, and the operating state of motor 54.

For example, when auxiliary cam 52 is in the position as shown in FIG. 9, switch 56 is in the off state. Then, a signal from switch 56 to CPU 103 causes the mechanism to be off. Then, if cam 50 is rotated to execute the cutting operation, switch 56 is pushed by the higher portion of auxiliary cam 52 to be closed.

While the cutting operation is performed, switch 56 continuously maintains the on state. Then, when cam 50 is rotated once to return to its original position, switch 56 is off.

The operation associated with switch 56 will be described in detail along with the description of the overall operation.

Figure 14:
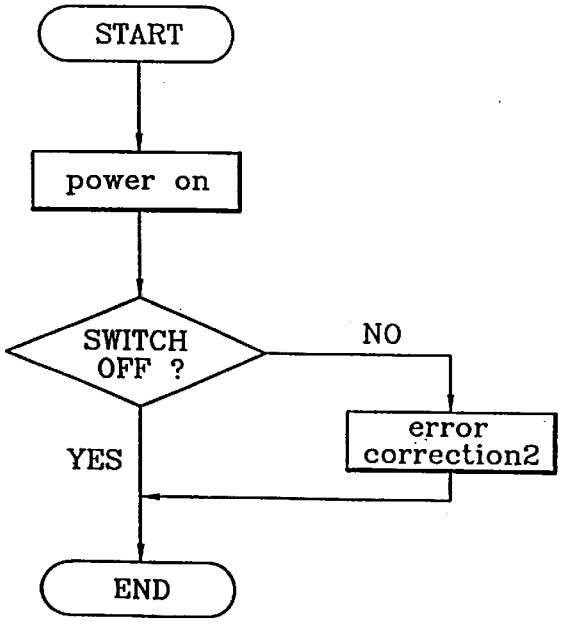
FIG. 14 is a flowchart showing the initialization of the present invention.
Figure 15:
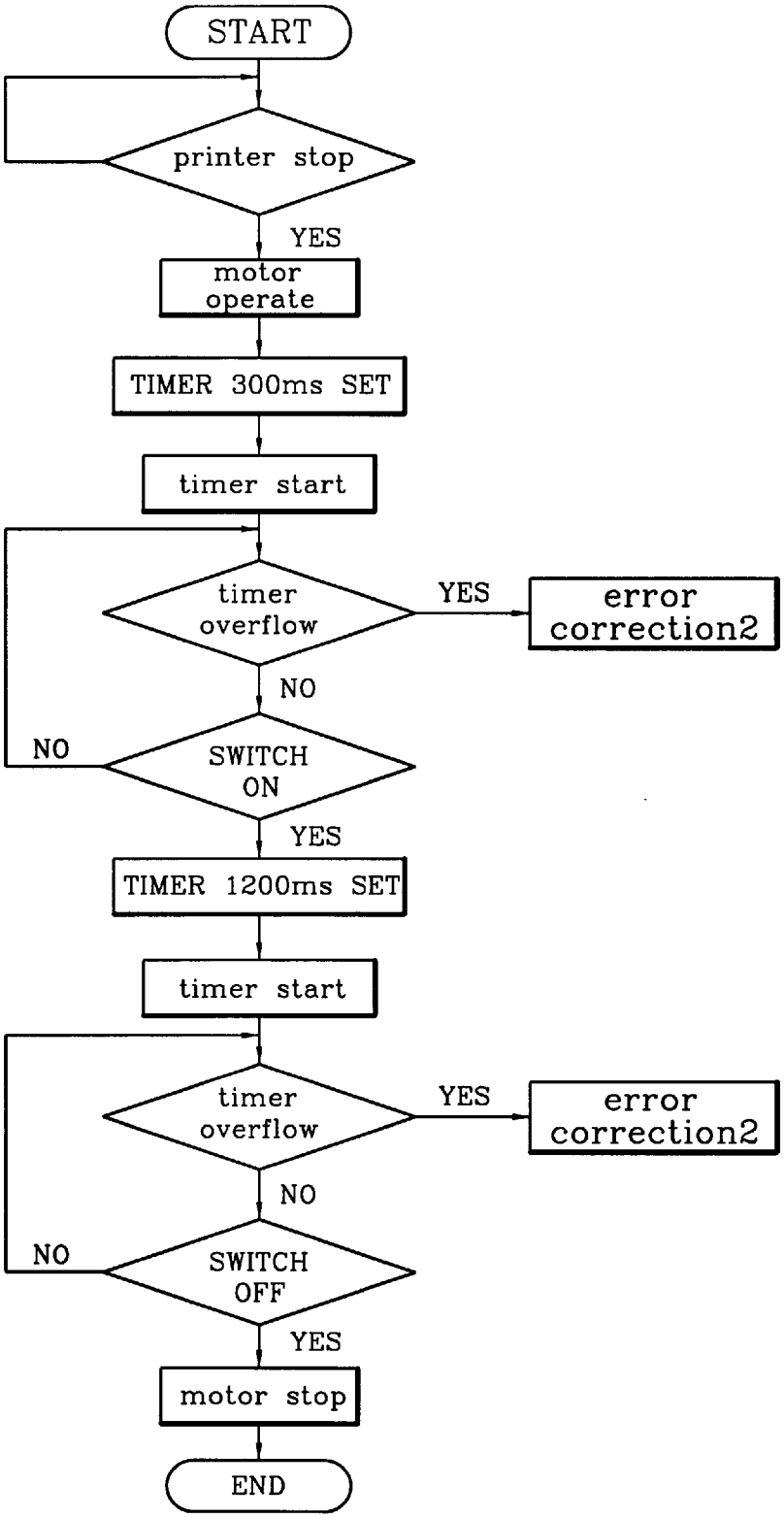
FIG. 15 is a flowchart for illustrating the overall operating state of the present invention.

Referring to the flowchart of FIG. 14, the interior treatment of the paper cutting apparatus will be described.

When the power of the small-sized printer is on, it is determined whether switch 56 is on or not.

This is for discriminating whether switch 56 is returned to the initial state or not. In case of the normal state, switch 56 is in the off state by returning to the initial state as shown in FIG. 9.

If switch 56 is on, error correction is carried out. Whereas, it is finished as it is in case of the off state. The error correction will be described in detail below.

To begin with, it is determined whether printer part 200 is stopped or not.

For this case, i.e., when the sheet of paper is cut by using the paper cutting apparatus, it is stopped by the printing operation of printer part 200.

If printer part 200 is not stopped, the determination is performed again. When printer part 200 is stopped, timer 106 is set to 300 ms to start the printer. At this time, 300 ms is set by estimating the time taken for reaching the on state from the initial state (off state) of switch 56, which is provided by considering the cutaway part of FIG. 9.

Then, when motor 54 starts to be forward rotated, cam 50 is rotated counter-clockwise in the drawing. By this rotation, cutter 4 begins to move in the advancing direction.

Thereafter, it is determined whether timer 106 overflows or not (whether 300 ms has elapsed or not).

That is, it is for determining whether switch 56 goes to the on state normally within the preset 300 ms interval. Unless switch 56 goes to the on state within 300 ms (if timer 106 overflows), the program proceeds to the error correction.

This error state indicates that switch 56 has its own failure, cutter 4 is stopped at the initial point by paper jam due to some reason, i.e., such as the restricted movement of cutter 4 in the advancing direction at the initial point due to some reason, or the like. The detailed content of the error correction will be provided later.

Whereas, when timer 106 does not overflow, it is determined whether switch 56 is on or not. If switch 56 is on, timer 106 is reset to 1200 ms to start timer 106.

Here, 1200 ms denotes the time required for completing the cutting operation once, which is set by considering the time taken for returning to the initial state by moving in the returning direction after cutter 4 is moved in the advancing direction to cut the sheet of paper together with fixed cutter 3.

After this, it is determined whether the time of timer 106 is up.

More specifically, it is determined whether one cutting operation is normally completed within the preset time interval of 1200 ms. If one cutting operation is not normally completed within the preset time of 1200 ms (if the time of timer 106 is up), it proceeds to the return processing state.

This instance is regarded as a case that cutter 4 is stopped during the step of moving in the advancing direction.

For example, it can be assumed that further movement of cutter 4 in the advancing direction is restricted due to a jam of a sheet of paper between cutter 4 and fixing cutter 3, or, for example, being locked while cutter 4 is moved in the returning direction.

These instances result in a state that the sheet of paper is not smoothly discharged after finishing the paper cutting operation and is jammed thus restricting the movement in the returning direction of cutter 4.

If the time of timer 106 is not up, it is determined whether switch 56 is off or not.

In more detail, when the cutting operation is normally completed, switch 56 is returned from the on state to the off state i.e. the initial state. Unless switch 56 is off, it returns to the routine to execute the determination again. Contrarily, when switch 56 is off, motor 54 is stopped to finish as it is.

By doing so, one cutting operation is normally finished.

Next, the aforementioned error correction will be described briefly.

The error correction refers to a procedure of returning the paper cutting apparatus to the normal initial state when cutter 4 is locked during performing the cutting operation even after switch 56 normally goes to the on state within the prescribed time period of 300 ms in the initial state. The other error correction refers to a procedure of, contrary to the above case, returning the paper cutting apparatus to the normal initial state, when switch 56 does not normally go to the on state within the prescribed time period of 1200 ms in the initial state.

In the paper cutting apparatus according to the present invention as described above in detail, one side of the elastic member is coupled to the cutter base to provide the compression force to the movable cutter by using the elasticity of the elastic member. Furthermore, the frictional force decreasing unit is furnished for leading the movable cutter to partially contact the bottom. By this construction, the transmitting force while the movable cutter is moved in the advancing direction during the cutting operation is consistently provided, and the motive power is directly transmitted to the cam to effectively control the driving load required for the cutting operation.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A paper cutter apparatus in a small-sized printer comprising:

a cutter base provided with a paper inlet in one side thereof;

a fixed cutter installed to one side of an upper portion of said cutter base;

a cutter cover installed to the upper portion of said cutter base for defining a space with said cutter base;

a movable cutter installed to the upper side of said cutter base, a shaft pin fixed on said movable cutter and extending upward therefrom, and guide means at a lower portion of the movable cutter for guiding the movable cutter with a straight advancing movement;

a cam mechanism installed to the bottom plane of said cutter cover in contact with said shaft pin of said movable cutter for producing movement of said movable cutter; and driving means for providing a rotative force to said cam mechanism;

whereby said movable cutter reciprocates forwardly and backwardly by the rotating operation of said cam mechanism to cut a sheet of paper.

2. A paper cutter apparatus in a small-sized printer as claimed in claim 1, wherein said guide means for guiding said movable cutter comprises:

a slide hole formed in the bottom of said cutter base and elongated in the direction of movement of said movable cutter;

a slide plate having a width identical to the width of said slide hole, said slide plate being engaged in said slide hole and installed to a bottom plane of said movable cutter;

a fixing plate attached to the bottom of said slide plate; and at least two fixing pins for fixing said slide plate and fixing plate to the bottom plane of said movable cutter, where said movable cutter can perform only a linear motion.

3. A paper cutting apparatus in a small-sized printer as claimed in claim 1, wherein said cam mechanism comprises a cam having a cam groove which receives said shaft pin of said movable cutter and a worm gear on a circumferential periphery of said cam, said cam being installed on a fixing shaft provided on said upper cutter cover.

4. A paper cutting apparatus in a small-sized printer as claimed in claim 3, wherein said cam groove of said cam mechanism has a heart shape in such a manner that an advancing section for moving said shaft pin of said movable cutter from a bottom dead center to a top dead center is relatively long, and a retreating section for moving said shaft pin of said movable cutter from said top dead center to said bottom dead center is relatively short.

5. A paper cutting apparatus in a small-sized printer as claimed in claim 3, wherein said driving means comprises:

a worm in meshing engagement with said worm gear on said circumferential periphery of said cam;

a motor for driving said worm;

said motor being attached to one side of said bottom plane of said cutter cover; and a switch attached to one side of said bottom plane of said cutter cover for stopping said motor.

6. A paper cutting apparatus in a small-sized printer comprising:

a cutter base provided with a paper inlet in one side thereof;

a fixed cutter installed to one side of an upper portion of said cutter base;

a cutter cover installed to the upper portion of said cutter base for defining a space with said cutter base;

a movable cutter installed to the upper side of said cutter base, a shaft pin fixed on said movable cutter and extending upward therefrom, and guide means at a lower portion of the movable cutter for guiding the movable cutter with a straight advancing movement;

a cam mechanism installed to the bottom plane of said cutter cover in contact with said shaft pin of said movable cutter for producing movement of said movable cutter; and driving means for providing a rotative force to said cam mechanism; and an auxiliary cam on a shaft of said cam mechanism for timely stopping said driving means, whereby said movable cutter reciprocates forwardly and backwardly by the rotating operation of said cam mechanism to cut a sheet of paper.

7. A paper cutting apparatus in a small-sized printer as claimed in claim 6, wherein said cam mechanism comprises a cam having a cam groove which receives said shaft pin of said movable cutter and a worm gear on a circumferential periphery of said cam, said cam being installed on a fixing shaft provided on said upper cutter cover.

8. A paper cutting apparatus in a small-sized printer as claimed in claim 7, wherein said cam groove of said cam mechanism has a heart shape in such a manner that an advancing section for moving said shaft pin of said movable cutter from a bottom dead center to a top dead center is relatively long, and a retreating section for moving said shaft pin of said movable cutter from said top dead center to said bottom dead center is relatively short.

9. A paper cutting apparatus in a small-sized printer as claimed in claim 7, wherein said driving means comprises:

a worm in meshing engagement with said worm gear on said circumferential periphery of said cam;

a motor for driving said worm;

said motor being attached to one side of said bottom plane of said cutter cover; and a switch attached to one side of said bottom plane of said cutter cover for stopping said motor.

10. A paper cutting apparatus in a small-sized printer as claimed in claim 7, wherein said auxiliary cam is integrally formed with said cam.

11. A paper cutting apparatus in a small-sized printer as claimed in claim 6, wherein said auxiliary cam is coaxial with said cam mechanism, and is shaped as a half moon to turn a switch on and off.

12. A paper cutting apparatus in a small-sized printer comprising:

a cutter base provided with a paper inlet in one side thereof;

a fixed cutter installed to one side of an upper portion of said cutter base;

a movable cutter installed for travel on an upper side of said fixed cutter, said movable cutter having means on a lower portion thereof engaged with said cutter base for guiding the movable cutter during its travel; and compressive means for contacting an upper plane of said movable cutter for applying a pressing force thereon during a paper cutting operation, said compressive means including an elastic member installed at left and right sides of said movable cutter, each elastic member having a fixed end and a free end and being flexible to apply said pressing force resiliently against the upper plane of said movable cutter, each said elastic member comprising an elastic plate whose fixed end is fixed to said cutter base and whose free end presses against the upper plane of said movable cutter.

13. A paper cutting apparatus in a small-sized printer as claimed in claim 12, wherein said elastic plate of said compressive means is shaped as an "L", said fixed end being a vertical leg of said L attached to said cutter base said free end being a horizontal leg of said L extending freely from said vertical leg for exerting said pressing force against said movable cutter.

14. A paper cutting apparatus in a small-sized printer as claimed in claim 12, wherein said fixed end of said elastic member of said compressive means is fixed to a cutter cover on said base.

15. A paper cutting apparatus in a small-sized printer as claimed in claim 12, wherein one said elastic plate of said compressive means is installed at right and left sides of said movable cutter.

16. A paper cutting apparatus in a small-sized printer comprising:

a cutter base provided with a paper inlet in one side thereof;

a fixed cutter installed to one side of an upper portion of said cutter base;

a movable cutter installed above said fixed cutter for travel thereon and having guide means on a lower portion thereof;

frictional force decreasing means placed between said cutter base and said movable cutter, said frictional force decreasing means contacting said cutter base and said movable cutter for maintaining a balance between said cutter base and said movable cutter during the movement of said movable cutter to decrease a frictional force between said cutter base and said movable cutter; and compressing means fixed to said cutter base for contacting an upper portion of said movable cutter to apply a resilient pressing force thereon during a paper cutting operation, said compressive means including an elastic member at left and right sides of said movable cutter, each elastic member having a fixed end and a free end to apply said pressing force resiliently against the upper plane of said movable cutter, each said elastic member comprising an elastic plate whose fixed end is fixed to said cutter base and whose free end presses against the upper plane of said movable cutter.

17. A paper cutting apparatus in a small-sized printer as claimed in claim 16, wherein said frictional force decreasing means comprises at least one small contact plate member fixedly attached to said upper plane of said cutter base for contact with said bottom plane of said movable cutter.

18. A paper cutting apparatus in a small-sized printer as claimed in claim 16, wherein said frictional force decreasing means comprises at least one projection protruding from a bottom of said cutter base to contact a bottom surface of said movable cutter.

19. A paper cutting apparatus in a small-sized printer as claimed in claim 16, wherein said elastic plate of said compressive means is shaped as an "L", said fixing end being a vertical lea of said L and said free end being a horizontal leg of said L, said fixing end being fixed to a side wall of said cutter base.

20. A paper cutting apparatus in a small-sized printer as claimed in claim 16, wherein said fixing end of said elastic plate of said compressive means is fixed to a cutter cover on said base.

21. A paper cutting apparatus in a small-sized printer as claimed in claim 16, wherein one said elastic plate of said compressive means is installed at right and left sides of said movable cutter.

22. A paper cutting apparatus in a small-sized printer comprising:

a cutter base provided with a paper inlet at one side thereof;

a fixed cutter installed at one side of an upper portion of said cutter base;

a cutter cover installed at said upper portion of said cutter base and providing a space with said cutter base;

a movable cutter installed at the upper portion of said cutter base, and a shaft pin on said movable cutter extending upwardly therefrom, said movable cutter having guide means for guiding said movable cutter in rectilinear movement;

a cam mechanism installed at a bottom surface of said cutter cover and receiving said shaft pin of said movable cutter for producing movement of said movable cutter;

driving means for driving said cam mechanism to produce reciprocal movement of said movable cutter to cut a sheet of paper inserted in said inlet, frictional force decreasing means placed between said cutter base and said movable cutter for contacting said cutter base and said movable cutter to maintain balance between said cutter base and said movable cutter during the movement of said movable cutter and to decrease frictional force between said cutter base and said movable cutter; and compressing means fixed to said cutter base to contact said upper portion of said movable cutter for producing an elastic, pressing force on said movable cutter in a paper cutting operation.

* * * * *